US009530579B2

(12) United States Patent
Inaba et al.

(10) Patent No.: US 9,530,579 B2
(45) Date of Patent: Dec. 27, 2016

(54) BYPASS SWITCH

(71) Applicant: MITSUBISHI ELECTRIC CORPORATION, Chiyoda-ku, Tokyo (JP)

(72) Inventors: Shigeru Inaba, Tokyo (JP); Nobumoto Tohya, Tokyo (JP); Minoru Kobayashi, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 14/914,082

(22) PCT Filed: Apr. 17, 2014

(86) PCT No.: PCT/JP2014/060940

§ 371 (c)(1),
(2) Date: Feb. 24, 2016

(87) PCT Pub. No.: WO2015/098142

PCT Pub. Date: Jul. 2, 2015

(65) Prior Publication Data

US 2016/0211088 A1 Jul. 21, 2016

(30) Foreign Application Priority Data

Dec. 26, 2013 (JP) ..... 2013-268297

(51) Int. Cl.
*H01H 3/46* (2006.01)
*H01H 3/38* (2006.01)
(Continued)

(52) U.S. Cl.
CPC ..... *H01H 3/38* (2013.01); *H01H 3/3031* (2013.01); *H01H 9/20* (2013.01); *H01H 33/666* (2013.01);
(Continued)

(58) Field of Classification Search
CPC .. H01H 33/6661; H01H 71/04; H01H 3/3015; H01H 31/003; H01H 33/666; H01H 33/6662; H01H 3/26; H01H 71/526; H01H 11/0062; H01H 2071/044; H01H 33/022; H01H 33/38; H01H 33/40; H01H 33/42
See application file for complete search history.

(56) References Cited

U.S. PATENT DOCUMENTS 3,679,852 A 7/1972 Himi et al.
3,845,263 A * 10/1974 Dickinson ..... H01H 33/666 200/275
(Continued)

FOREIGN PATENT DOCUMENTS

DE 2114771 A1 10/1971
JP 51-35713 B1 10/1976
(Continued)

OTHER PUBLICATIONS

International Search Report (PCT/ISA/210) issued on Jul. 8, 2014, by the Japanese Patent Office as the International Searching Authority for International Application No. PCT/JP2014/060940.
(Continued)

*Primary Examiner* — Truc Nguyen
(74) *Attorney, Agent, or Firm* — Buchanan Ingersoll & Rooney PC

(57) ABSTRACT

Provided is a bypass switch with the closing time shortened. A bypass switch using a vacuum valve having a fixed contact and a movable contact includes: an insulating rod having one end side connected to the movable contact; a closing spring fitted to the other end side of the insulating rod, and having a closing function to close the contacts and a contact-pressing function to apply pressure to the contacts; and an operation unit having a latch function to keep a contact-opened state, and connected to the other end side of the
(Continued)

insulating rod, wherein the insulating rod, the closing spring, and the operation unit are arranged in series along the axial direction of the vacuum valve.

4 Claims, 3 Drawing Sheets

(51) Int. Cl.
*H01H 33/666* (2006.01)
*H01H 9/20* (2006.01)
*H01H 3/30* (2006.01)
*H01H 79/00* (2006.01)

(52) U.S. Cl.
CPC ..... *H01H 79/00* (2013.01); *H01H 3/3052* (2013.01); *H01H 3/46* (2013.01); *H01H 2235/01* (2013.01)

(56) References Cited

U.S. PATENT DOCUMENTS 3,849,619 A * 11/1974 Patel ..... H01H 3/42 200/401
3,921,109 A * 11/1975 Hodgson ..... H01H 1/54 218/32
4,419,553 A * 12/1983 Ohshita ..... H01H 33/666 200/401
4,791,250 A 12/1988 Yin
5,864,109 A * 1/1999 Ahn ..... H02B 11/133 218/120
6,545,234 B1 * 4/2003 Trivette ..... H01H 33/666 200/50.21
6,657,150 B1 12/2003 Shea et al.
9,431,184 B2 * 8/2016 Lee ..... H01H 3/32
2006/0250200 A1 * 11/2006 Babu ..... H01H 71/505 335/6
2008/0129429 A1 * 6/2008 Ricciuti ..... H01H 71/7463 335/38
2010/0078300 A1 * 4/2010 Freundt ..... H01H 3/30 200/337
2012/0125752 A1 5/2012 Yamamoto et al.

FOREIGN PATENT DOCUMENTS

JP 58-27829 2/1983
JP 59-8932 A 1/1984
JP 7-105796 A 4/1995

OTHER PUBLICATIONS

Decision to Grant a Patent issued in the corresponding Japanese Application No. 2015-503599 on Jul. 3, 2015, pp. 1-3 (with English language translation, 3 pages).
Notification of Reasons for Refusal issued in the corresponding Japanese Application No. 2015-503599 on Apr. 14, 2015, pp. 1-3 (with English language translation, 3 pages).
Extended European Search Report dated Aug. 4, 2016, issued by the European Patent Office in corresponding European Application No. 14873245.6. (10 pages).

* cited by examiner

BYPASS SWITCH

TECHNICAL FIELD

The present invention relates to a bypass switch used in power electronics equipment or the like.

BACKGROUND ART

In recent years, renewable energy has been increasingly introduced in an electric power field, and as a measure for system stabilization, introduction or enhancement of power electronics equipment such as a STATCOM (static synchronous compensator) is performed. In the power electronics equipment, a voltage converter is needed, and in the voltage converter, a semiconductor such as an IGBT is used as a switch for current. In the converter, a bypass switch is needed for protecting a diode or preventing breakdown of the system upon failure of the IGBT. The bypass switch is to protect the diode or prevent breakdown of the system by short-circuiting and closing the bypass switch itself upon failure of the IGBT. Therefore, the bypass switch needs to operate before the diode fails. However, since the time until the diode fails is very short, it is important, as a required function of the bypass switch, that the time until closing since reception of a signal is as short as possible.

The bypass switch used in the power electronics equipment is required to allow high voltage or large current to be applied by means of short-circuit closing. Therefore, a vacuum valve may be employed for a switch main unit.

An example of conventional operation mechanism units for the vacuum valve includes: an open/close rod connected to a movable contact of the vacuum valve; an open/close block which is provided to the open/close rod, movable in the axial direction, and engaged via a predetermined play; and a disk-like open/close spring which is displaced in accordance with movement of the open/close block and has a greater turnover load to the open/close block than a vacuum-self-closing force of the vacuum valve, wherein the open/close block is moved in the axial direction by an operation lever, whereby the open/close spring acts in a contact-opening or contact-closing direction to perform contact opening or contact closing (for example, see Patent Document 1).

CITATION LIST

Patent Document

Patent Document 1: Japanese Examined Patent Publication No. 59-8932 (pages 1 and 2, FIGS. 1 to 4.

SUMMARY OF THE INVENTION

Problems to be Solved by the Invention

In the case of using, as the bypass switch, such a vacuum valve having an operation mechanism as in Patent Document 1, in the closing operation, the open/close block connected to the movable contact is directly driven by a drive mechanism, and there is a problem that it takes some time since the operation lever is pressed to the open/close block to start operation until the disk-like open/close spring turns over in the contact-closing direction and the contact is closed.

Instead of the disk-like open/close spring, a method in which an operation rod and an operation mechanism unit are linked via a link mechanism to perform a closing operation is also widely known. However, even in this case, it still takes a time of, for example, about several tens ms since start of the closing operation until completion thereof.

The present invention has been made to solve the above problems, and an object thereof is to obtain a bypass switch with the closing time shortened.

Solution to the Problems

A bypass switch according to the present invention is a bypass switch using a vacuum valve having a fixed contact and a movable contact, the bypass switch including: an insulating rod having one end side connected to the movable contact; a closing spring having a closing function and a contact-pressing function, and fitted to another end side of the insulating rod; and an operation unit having a latch function to keep a contact-opened state, and connected to the other end side of the insulating rod, wherein the insulating rod, the closing spring, and the operation unit are arranged in series along an axial direction of the vacuum valve.

Effect of the Invention

In the bypass switch of the present invention, the insulating rod connected to the movable contact, the closing spring having the closing function and the contact-pressing function, and the operation unit having the latch function to keep the contact-opened state are provided on the drive side of the vacuum valve composing the switch main unit, and these components are arranged in series along the axial direction of the vacuum valve. Therefore, a force of the closing spring can be smoothly transmitted to the movable contact, and the closing time taken to cancel the engagement of the latch and complete the closing can be shortened.

In addition, since the structure of the operation unit is simplified and the number of components in the movable part is reduced, the weight of the operation unit can be reduced. Further, since the assembly is facilitated, the assembly time can be shortened.

DESCRIPTION OF EMBODIMENTS

Embodiment 1

Figure 1:
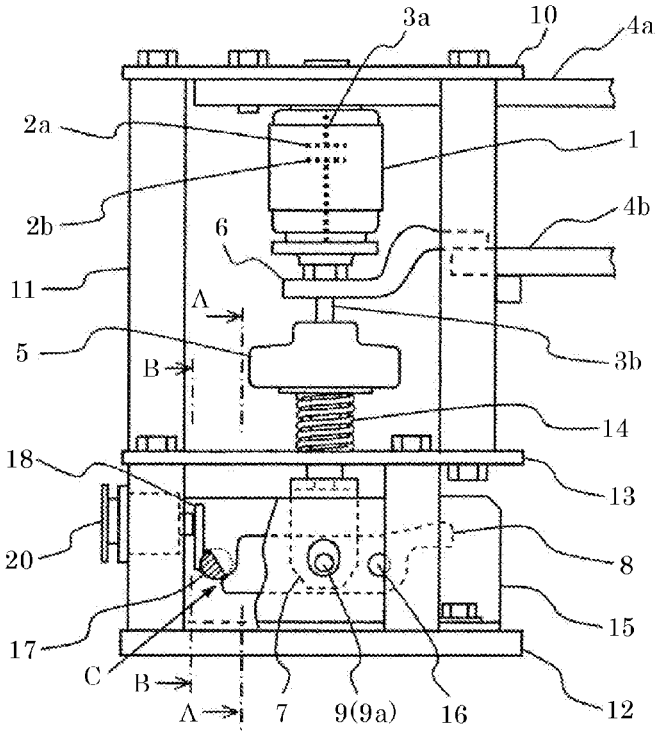
FIG. 1 is a side view showing a contact-opened state of a bypass switch according to embodiment 1 of the present invention.
Figure 2:
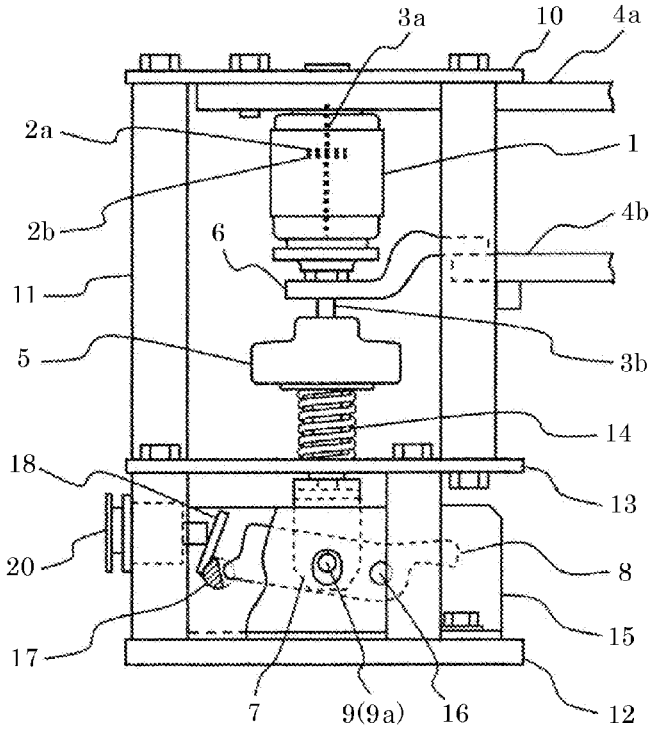
FIG. 2 is a side view showing a contact-closed state of the bypass switch according to embodiment 1 of the present invention.

Hereinafter, the description will be given based on the drawings. FIG. 1 and FIG. 2 are side views of a bypass switch according to embodiment 1 of the present invention. FIG. 1 shows a contact-opened state, and FIG. 2 shows a contact-closed state. In FIG. 1 and FIG. 2, for convenience sake, the left side is referred to as a front side.

For a switch main unit of the bypass switch, a vacuum valve is used. First, the entire configuration will be described with reference to FIG. 1. In FIG. 1 and FIG. 2, the sectional views are shown in a partially broken manner so as to facilitate understanding of the internal structure.

A vacuum valve 1 has a fixed contact 2*a* and a movable contact 2*b* provided in a vacuum chamber so as to be able to contact with each other and be separated from each other. The fixed contact 2*a* is connected to a fixed-side conductor 4*a* via a fixed-side electrode rod 3*a*, the movable contact 2*b* is connected to a movable-side electrode rod 3*b*, and the other end of the movable-side electrode rod 3*b* is led out of the vacuum chamber, to be connected to an insulating rod 5. The movable-side electrode rod 3*b* is connected to a movable-side conductor 4*b* via a flexible conductor 6.

A coupling metal member 7 is connected to an end of the insulating rod 5 opposite to the side connected to the movable-side electrode rod 3*b*, and the coupling metal member 7 is coupled with a lever 8 via a coupling pin 9.

The fixed-side conductor 4*a* is fixed to a horizontal frame 10 on the upper side, the horizontal frame 10 is supported by a vertical frame 11, and a lower end side of the vertical frame 11 is fixed to a base 12. An intermediate horizontal frame 13 is provided at an intermediate part of the vertical frame 11, and a part below the intermediate horizontal frame 13 is an operation unit.

Directly under the insulating rod 5, a coil-like closing spring 14 is fitted to the insulating rod 5, and energizes the movable contact 2*b* in the contact-closing direction, between the insulating rod 5 and the intermediate horizontal frame 13.

The closing spring 14 drives the movable contact 2*b* in the closing direction, and energizes the movable contact 2*b* to the fixed contact 2*a* side in the contact-closed state.

Figure 3:
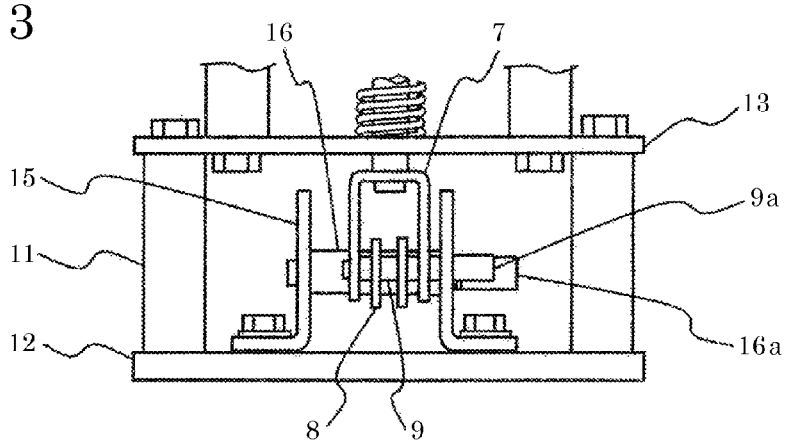
FIG. 3 is a sectional view of an operation unit as seen from an A-A direction in FIG. 1.
Figure 4:
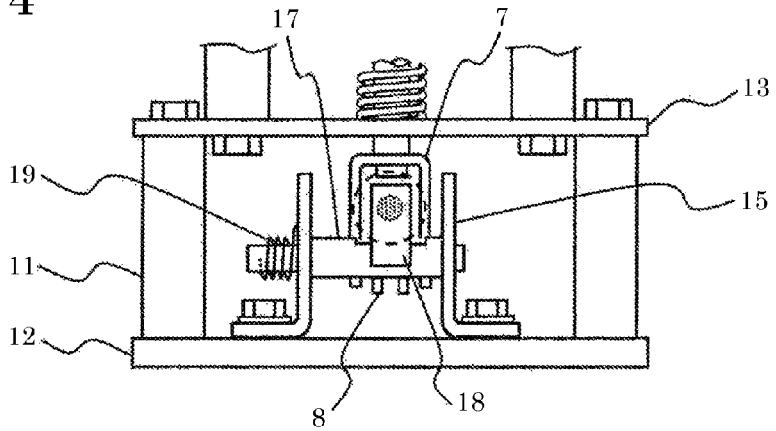
FIG. 4 is a sectional view of the operation unit as seen from a B-B direction in FIG. 1.

FIG. 3 is a front sectional view as seen from an A-A direction in FIG. 1. FIG. 4 is a front sectional view as seen from a B-B direction in FIG. 1. With reference to also FIG. 3 and FIG. 4, the configuration of the operation unit will be described.

On the base 12, a support member 15 for supporting the operation unit is fixed by a bolt. As shown in FIG. 3, the support member 15 is composed of two plate-like members each having an L shape as seen from the front side, and is fixed on the base 12 such that the vertical planes of the plate-like members face each other via a predetermined interval.

On the back side as seen from the front side of the support member 15, one end side of the lever 8 is rotatably supported by a lever fixation pin 16. On the front side of the lever 8, a latch 17 is provided which can be engaged at an engagement part C (see FIG. 1) formed on the other end side of the lever 8. The latch 17 is rotatably provided on the support member 15. The latch 17 is formed by a round-bar member a part of which along the longitudinal direction is cut so as to have a semicircular cross section, and thus formed as a so-called semicircular latch. The corner of the semicircular part corresponds to the engagement part C. Thus, the latch is a mechanical latch.

The coupling metal member 7 provided at the end of the insulating rod 5 is connected by the coupling pin 9 at an intermediate part between the lever fixation pin 16 serving as a pivot of the lever 8 and the engagement part on the front end side.

On the latch 17, a latch drive piece 18 is fixed being directed orthogonally to the axial direction of the latch 17. As shown in FIG. 4, a return spring 19 formed by, for example, a coil spring is provided between the latch 17 and the support member 15. By the return spring 19, the latch 17 is energized in the counterclockwise direction as seen from the direction in FIG. 1.

A solenoid 20 of a direct-acting type is provided at a position opposed to the latch drive piece 18. The solenoid 20 is fixed on the vertical frame 11 side or the support member 15 side, although not shown. By a coil of the solenoid 20 being excited, the latch drive piece 18 is pressed and the latch 17 is turned in the clockwise direction in FIG. 1.

As shown in FIG. 3, the lever fixation pin 16 has, at one end side thereof (in the present embodiment, the right side as seen from the front side), a protrusion 16*a* protruding outward of the support member 15. Similarly, the coupling pin 9 for fastening the coupling metal member 7 has, at one end side thereof (the same side as the protrusion 16*a*), a protrusion 9*a* protruding outward of the support member 15. As shown in FIG. 1, a relief hole is formed at a part where the protrusion 9*a* penetrates through the support member 15, so that the vertical movement of the protrusion 9*a* is not regulated by the support member 15. The purposes of the protrusions 9*a* and 16*a* will be described later.

Next, operation of each part will be described. First, the closing operation of the vacuum valve 1 will be described.

In the contact-opened state as shown in FIG. 1, the solenoid 20 is not excited, the latch 17 is energized by the return spring 19 so as to turn in the counterclockwise direction, and the semicircular-shaped latch 17 and the lever 8 are engaged with each other at the engagement part C as shown in FIG. 1, whereby the lever 8 is prevented from turning in the clockwise direction and the contact-opened state is kept. At this time, the closing spring 14 stores energy.

Here, when the solenoid 20 is excited in response to a contact-closing command, the latch drive piece 18 is pressed and the latch 17 is turned in the clockwise direction. By this operation, the engagement between the latch 17 and the lever 8 is cancelled, the closing spring 14 is released, and then the movable contact 2*b* together with the insulating rod 5 and the movable-side electrode rod 3*b* instantaneously moves to the fixed contact 2*a* side, to come into contact with the fixed contact 2*a*, whereby the movement is stopped, leading to the contact-closed state as shown in FIG. 2. The closing spring 14 is set so as to contract from its natural length even in the contact-closed state. Therefore, in the contact-closed state, the contacts 2*a* and 2*b* are in contact with each other under a constant contact-pressure load. Even if the excitation of the solenoid 20 is cancelled, the contact state is kept.

Next, the contact-opening operation will be described.

Figure 5:
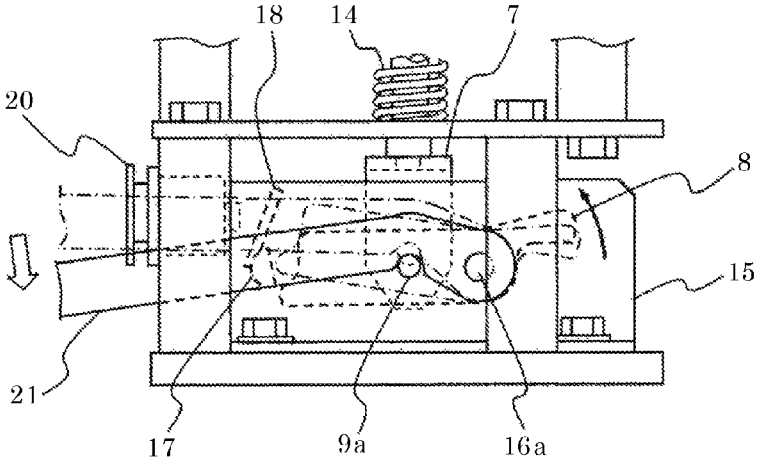
FIG. 5 is an explanation diagram for explaining a contact-opening operation of the bypass switch in FIG. 1.

FIG. 5 is an explanation diagram for explaining the contact-opening operation. The contact-opening operation is manually performed using an operation handle 21. As shown in FIG. 5, a hole provided at one end of the operation handle 21 is fitted to the protrusion 16*a* of the lever fixation pin 16, and an engagement recess formed in a side surface of the operation handle 21 is engaged with the protrusion 9*a* of the coupling pin 9. By pushing down the other end side of the operation handle 21 in a thick-arrow direction with a force equal to or greater than the energization force of the closing spring 14, the coupling pin 9 moves downward, and along with this, the insulating rod 5 moves downward, whereby the contact pressure load is released and contact opening is started. When the operation handle 21 is further pushed down to move the engagement part of the lever 8 downward over the latch 17 and thereby the interference is cancelled, the latch 17 turns in the counterclockwise direction by the return spring 19, and the latch 17 and the lever 8 can be engaged with each other at the engagement part C, leading to the state as shown in FIG. 1.

Thus, the closing spring 14 provided directly under the insulating rod 5 is released by operation of the operation unit provided under the closing spring 14. Therefore, it becomes possible to perform high-speed operation after the closing operation is started, whereby the closing time can be shortened. In addition, the structure is simplified and the weight is reduced, as compared to the case of using a link or the case of using the disk-like spring as in Patent Document 1.

Since a semicircular latch is employed as the latch, the engagement with the engagement part can be cancelled by slight turning of the latch, thus contributing to increase in the speed of the closing operation.

As described above, the bypass switch of embodiment 1 is a bypass switch using a vacuum valve having a fixed contact and a movable contact, and including: an insulating rod having one end side connected to the movable contact; a closing spring having a closing function and contact-pressing function and fitted to the other end side of the insulating rod; and an operation unit having a latch function to keep a contact-opened state and connected to the other end side of the insulating rod, wherein the insulating rod, the closing spring, and the operation unit are arranged in series along the axial direction of the vacuum valve. Therefore, a force of the closing spring can be smoothly transmitted to the movable contact, and the closing time taken to cancel the engagement of the latch and complete the closing can be shortened.

In addition, since the structure of the operation unit is simplified and the number of components in the movable part is reduced, the weight of the operation unit can be reduced. Further, since the assembly is facilitated, the assembly time can be shortened.

The operation unit includes: a lever having one end side rotatably supported by a support member, the other end side at which an engagement part is formed, and an intermediate part coupled with the other end side of the insulating rod; a latch that can be engaged with an engagement part of the lever; and a solenoid for driving the latch, wherein the contact-opened state is kept by the latch being engaged with the engagement part of the lever, and the closing spring is released to perform contact closing by the engagement being cancelled by excitation of the solenoid. Therefore, it becomes possible to keep the contact-opened state and perform quick contact-closing operation, with a simple configuration.

Embodiment 2

Figure 6:
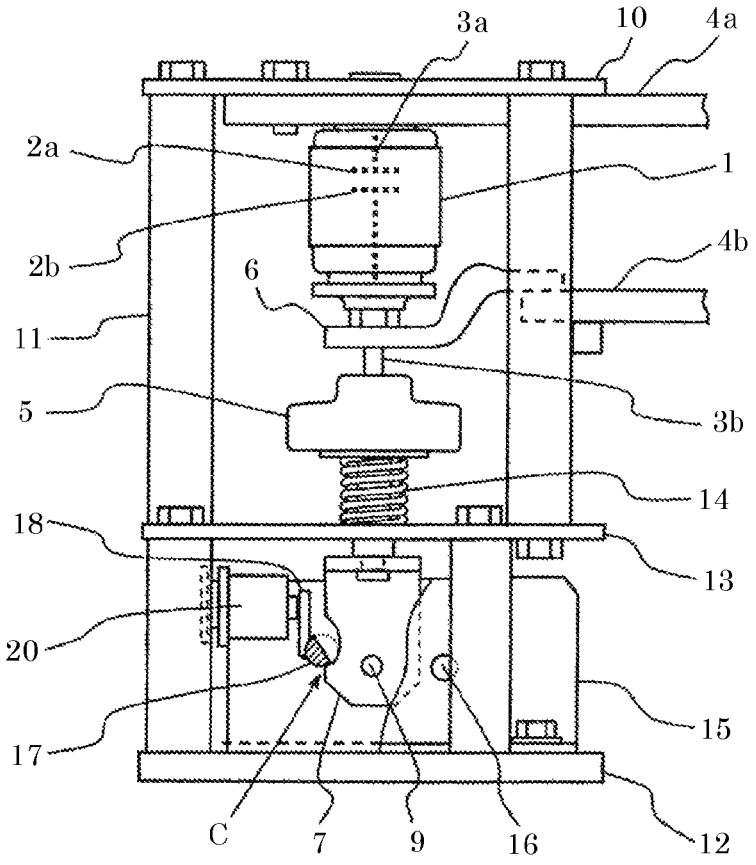
FIG. 6 is a side view of a bypass switch according to embodiment 2 of the present invention.

FIG. 6 is a side view of a bypass switch according to embodiment 2. While the components corresponding to those in FIG. 1 in embodiment 1 are denoted by the same reference characters and the description thereof is omitted, a different part will be mainly described. The different part is the structure of the operation unit below the closing spring 14. In FIG. 6, the sectional view is shown in a partially broken manner so as to facilitate understanding of the internal structure.

As shown in FIG. 6, in the structure of the operation unit, the lever 8 in FIG. 1 is removed, and an engagement part that can be engaged with the latch 17 is directly provided to the coupling metal member 7 provided at the end of the insulating rod 5.

The shape of the latch 17 and the shape of the latch drive piece 18 fixed thereto are the same as in embodiment 1. The latch 17 is located at such a position that, depending on the turn position thereof, allows the latch 17 to be engaged with the engagement part of the coupling metal member 7, and is rotatably attached to the support member 15. The solenoid 20 for pressing the latch drive piece 18 is fixed on the support member 15 side.

FIG. 6 shows a contact-opened state, in which the latch 17 is turned in the counterclockwise direction by the return spring 19, to be engaged at the engagement part C, thereby keeping the contact-opened state. From this state, when the solenoid 20 is excited in response to a contact-closing command, the latch drive piece 18 is pressed to turn the latch 17 in the clockwise direction, the engagement is cancelled, and the closing spring 14 is released, whereby the contacts are closed. A contact-opening operation is performed by the operation handle 21 as in embodiment 1.

By such a configuration, since the latch 17 is directly engaged with the coupling metal member 7, as compared to embodiment 1, the lever 8 is removed and downsizing and weight reduction of the movable part can be achieved, and further, the closing time can be shortened.

In FIG. 6, the latch 17 and the solenoid 20 are provided only on one side of the coupling metal member 7. However, such components may be provided on both sides. In this case, a force is applied evenly with respect to the central axis, whereby more stable operation is achieved.

As described above, in the bypass switch of embodiment 2, the operation unit includes: a latch that can be engaged with an engagement part of the coupling metal member coupled with the other end side of the insulating rod; and a solenoid for driving the latch, wherein the contact-opened state is kept by the latch being engaged with the engagement part of the coupling metal member, and the closing spring is released to perform contact closing by the engagement being cancelled by excitation of the solenoid. Therefore, the structure of the operation unit is simplified, and downsizing and weight reduction of the movable part can be achieved.

It is noted that, within the scope of the present invention, the above embodiments may be freely combined with each other, or each of the above embodiments may be modified or abbreviated as appropriate.

DESCRIPTION OF THE REFERENCE CHARACTERS

1 vacuum valve
2*a* fixed contact
2*b* movable contact
3*a* fixed-side electrode rod
3*b* movable-side electrode rod
4*a* fixed-side conductor
4*b* movable-side conductor
5 insulating rod
6 flexible conductor
7 coupling metal member
8 lever
9 coupling pin
9*a* protrusion
10 horizontal frame
11 vertical frame
12 base
13 intermediate horizontal frame
14 closing spring
15 support member
16 lever fixation pin
16*a* protrusion
17 latch
18 latch drive piece
19 return spring
20 solenoid
21 operation handle

The invention claimed is:

1. A bypass switch comprising:

a vacuum valve having a fixed contact and a movable contact;

an insulating rod having one end side connected to the movable contact;

a closing spring having a closing function and a contact-pressing function, and fitted to another end side of the insulating rod;

a lever having one end side rotatably supported by a support member, another end side at which an engagement part is formed, and an intermediate part coupled with the other end side of the insulating rod;

a bar-like latch having a cutout formed by cutting a part of the bar-like latch along a longitudinal direction so as to have a semicircular cross section, and rotatably supported by the support member, such that the bar-like latch can be engaged with and be detached from the engagement part of the lever by being turned around an axis in the longitudinal direction; and a solenoid to rotationally drive the bar-like latch around the axis, wherein a combination of the lever, the latch, and the solenoid composes an operation unit, the insulating rod, the closing spring, and the operation unit are arranged in series along an axial direction of the vacuum valve, a contact-opened state is kept by the latch being engaged with the engagement part of the lever, and the closing spring is released to perform contact closing by the engagement being cancelled by excitation of the solenoid.

2. The bypass switch according to claim 1, wherein both ends of a supported portion of the lever and both ends of the latch are supported by the support member.

3. The bypass switch according to claim 1, wherein the other end side of the insulating rod and the intermediate part of the lever are coupled with each other by a coupling metal member having a U-shaped cross section, the coupling metal member being attached to the other end side of the insulating rod and being coupled with the lever by a coupling pin so as to stride the lever.

4. A bypass switch comprising:

a vacuum valve having a fixed contact and a movable contact;

an insulating rod having one end side connected to the movable contact;

a closing spring having a closing function and a contact-pressing function, and fitted to another end side of the insulating rod;

a coupling metal member coupled with the other end side of the insulating rod, and having an engagement part at a side part thereof in a direction orthogonal to the coupling direction;

a bar-like latch having a cutout formed by cutting a part of the bar-like latch along a longitudinal direction so as to have a semicircular cross section, and rotatably supported by a support member, such that the bar-like latch can be engaged with and be detached from the engagement part at the side part of the coupling metal member by being turned around an axis in the longitudinal direction; and a solenoid to rotationally drive the bar-like latch around the axis, wherein a combination of the coupling metal member, the latch, and the solenoid composes an operation unit, the insulating rod, the closing spring, and the operation unit are arranged in series along an axial direction of the vacuum valve, a contact-opened state is kept by the latch being engaged with the engagement part of the coupling metal member, and the closing spring is released to perform contact closing by the engagement being cancelled by excitation of the solenoid.

* * * * *